United States Patent [19]

Webster

[11] 4,029,917

[45] June 14, 1977

[54] MOLDED MULTIPLE SWITCH MECHANISM

[75] Inventor: John L. Webster, Painesville, Ohio

[73] Assignee: A P Products Incorporated, Painesville, Ohio

[22] Filed: June 21, 1976

[21] Appl. No.: 698,117

[52] U.S. Cl. ..... 200/5 R; 200/16 D

[51] Int. Cl.[2] ..... H01H 9/00; H01H 15/00

[58] Field of Search ..... 200/1 R, 5 R, 5 A, 11 DA, 200/16 R, 16 C, 16 D, 17 R, 18, 60, 159, 164 R, 252–261, 292, 293–296, 303, 308

[56] References Cited

UNITED STATES PATENTS

| | | | |
|---|---|---|---|
| 3,582,578 | 6/1971 | Lockard | 200/16 D |
| 3,586,797 | 6/1971 | Gerhardt et al. | 200/292 X |
| 3,624,320 | 11/1971 | Eberhart et al. | 200/16 R |
| 3,806,685 | 4/1974 | Seeger, Jr. et al. | 200/159 B X |
| 3,886,341 | 5/1975 | Forrest | 200/159 B X |
| 3,963,884 | 6/1976 | Pollock | 200/16 D |
| 3,971,903 | 7/1976 | Wilentchik | 200/16 C |
| 3,974,346 | 8/1976 | Keprda | 200/333 X |

FOREIGN PATENTS OR APPLICATIONS

| | | | |
|---|---|---|---|
| 2,524,287 | 12/1975 | Germany | 200/16 |

OTHER PUBLICATIONS

Western Electric Technical Digest, No. 9, Jan, 1968, p. 25, J. S. Baynard, Jr. et al., "Boroprobe".

*Primary Examiner*—James R. Scott
*Attorney, Agent, or Firm*—Donnelly, Maky, Renner & Otto

[57] ABSTRACT

A multiple switch device is connectable on-line between a multiple conductor electrical cable termination assembly or the like and a receptacle or the like to which the assembly would otherwise be connected. The multiple switch device includes a plurality of slide switches that are selectively actuable to slide directly on contacts integrally molded in a common body part of the device to open or to close respective circuits. A plastic bridge molded in the common body part between respective pairs of contacts over which a common slide switch glides provides a generally continuous planar surface to facilitate such motion without unnecessary wear to the contacts or the slide switch.

12 Claims, 4 Drawing Figures

MOLDED MULTIPLE SWITCH MECHANISM

BACKGROUND OF THE INVENTION

The present invention relates, in general, to a multiple switch device and, in particular, to an off board, on-line multiple switch device for selectively opening and closing circuits of a multi-conductor electrical cable termination assembly. Moreover, the invention relates to an improved multiple switch device wherein the multiple contacts, which may connect to an external terminals, cable termination assemblies, or the like, are molded into a common body part of the device and extensions of respective pairs of those multiple contacts provide the switch contacts over which an electrically conductive slide glides to open or to close respective circuits.

Multi-conductor electrical cables, such as flat ribbon-type cables, are employed, for example, to provide simultaneous electrical connection of a plurality of circuits at one location to another plurality of circuits at another location. To facilitate connecting such a cable to such circuits respective multiple contact terminations are secured at each end of the cable to connect the conductors thereof with respective contacts of a multiple contact receptacle, or the like, which terminate such circuits. The combination of such a multi-conductor electrical cable and termination therefor is usually referred to as a multi-conductor electrical cable termination assembly, cable termination assembly, or the like.

Typically such multi-conductor electrical cables of the flat ribbon-type, for example, have more than two and usually on the order of from about 20 to about 50 or even more conductors, and the terminations therefor include a corresponding number of electrical contacts usually arranged in plural, normally two, parallel rows in a conventional dual-in-line pattern for facility of manipulation and compactness. Such terminations usually may be categorized as either female or male type, depending on the type of electrical contact employed therein, such as, for example, fork contacts or pin contacts, respectively.

An advantage of such usage of cable termination assemblies is the facility with which many connections can be simultaneously made. Another advantage is the relative compactness of the cable termination assembly, which enables those many connections to be made in a relatively small space. However, one disadvantage encountered in the past using such cable termination assemblies has been the inability to switch open or closed selected conductor circuits thereof with facility while at the same time maintaining the above and other advantages.

In a co-pending U.S. patent application Ser. No. 676,900, filed Apr. 14, 1976, which application is assigned to the same assignee as the present application, there is disclosed a Multiple Switch Device that is an off-board device, i.e. not necessarily located on a circuit board or other electrical apparatus, which is connectable between a cable termination assembly and its receptacle in on-line relation to both the assembly termination and its receptacle, i.e. physically present adjacent both. On-line means that the multiple switch device is connectable physically as an extension of a multi-conductor cable termination assembly between the latter and its receptacle, as opposed to being a remotely located device, and this on-line feature, therefore, facilitates overall circuit assembly, reduces circuit materials, enhances the integrity of the connections, and so on. Receptacle, as used in the present and co-pending applications, refers generally to any device adapted for connection with a cable termination assembly, whether the termination of another such assembly, a socket, terminal, or the like of a circuit board, of a computer or of any other electrical apparatus, etc. When so connected on-line, the multiple switch device may be selectively adjusted to open or to close each of the conductor circuits between the cable termination assembly and its receptacle while still maintaining the mentioned facility of connection and compactness advantages.

The multiple switch device of such co-pending application employs respective pairs of electrically isolated printed circuits that may be selectively bridged by electrically conductive slides to complete respective circuits in the switch housing and, thus, between respective electrical contacts that are soldered to opposite sides of each such switch circuit. Plastic or similar material is molded about each end of the printed circuit board to enclose the solder connections, and the plurality of printed circuits are exposed for placement of respective slides for movement thereon to open and to close respective switch circuits. Moreover, to facilitate the gliding movement of the respective slides and to avoid unnecessary wearing of the printed circuits and the slides, the electrical discontinuity between respective printed electrically conductive paths of each pair of printed circuits is formed on a bias with respect to the linear extent of each path so that the contact portions of each slide move only in a single plane and do not encounter any step at the juncture of one path and the electrical discontinuity.

SUMMARY OF THE INVENTION

The improved multiple switch device of the present invention is an off-board, on-line device that may be selectively operated to open and to close respective circuits between a cable termination assembly and its receptacle. In one embodiment of the invention the pair of male and female contacts, for example, which are to be selectively connected or disconnected by a respective switch circuit in the improved multiple switch device, have extensions forming the fixed switch contact portions of such switch circuit. Those contacts are held in an electrically non-conductive common body part that is molded thereabout to form an integral structure securing the contacts in fixed relative positions with one end of each protruding in exposure for connection to another external contact or the like and with one surfaces of the other end of each exposed as respective switch contact portions on which electrically conductive slide contacts may be linearly slid. The exposed surfaces of each respective pair of linearly aligned contacts that form the fixed switch contact portions of respective switch circuits are preferably substantially coplanar.Moreover, there is a space between the confronting ends of each such respective pair of linearly aligned contacts to provide an electrical discontinuity therebetween, and the common body part is molded to provide a bridge filling such space to a level coplanar with the exposed surfaces of the contacts. Therefore, the respective slide contacts may be easily slid over the mechanically continuous or flat support of the respective contact surfaces and non-conductive bridge selectively to open and to close respective switch circuits.

The improved multiple switch device of the present invention has many of the advantages of the multiple switch device of the co-pending application, including the ability simultaneously and selectively to connect and to disconnect a plurality of circuits between a cable termination assembly and its receptacle, and, as additional advantages, requires fewer parts and manufacturing steps than the latter device. Also, by eliminating the printed circuit board various tolerance problems, such as contact spacing, and labor involved in the manufacturing of that part alone are eliminated.

With the foregoing in mind it is a principal object of the invention to switch open and closed selectively the respective circuits of a multi-conductor electrical cable termination assembly.

Another object is to facilitate the manufacture and construction of an improved multiple switch device and, moreover, to effect the same while improving manufactured tolerances thereof.

A further object is to switch open and closed selectively and directly on-line therewith respective multiple circuits of a cable termination assembly and its receptacle.

An additional object is to open or to close selectively each line in a multi-conductor electrical cable, such as a ribbon cable, for testing, circuit programming, and the like.

Still a further object is to avoid inadvertent switching of the switches of a multiple switch device.

Still another object is to retain a slide switch in a given position.

Yet another object is to avoid undue wearing of a slide contact and/or fixed switch contacts of a slide-type switch and thus to increase the longevity thereof.

These and other objects and advantages of the present invention will become more apparent as the following description proceeds.

To the accomplishment of the foregoing and related ends, the invention, then, comprises the features hereinafter fully described and particularly pointed out in the claims, the following description and the annexed drawing setting forth in detail a certain illustrative embodiment of the invention, this being indicative, however, of but one of the various ways in which the principles of the invention may be employed.

DESCRIPTION OF THE PREFERRED EMBODIMENT

Figure 1:
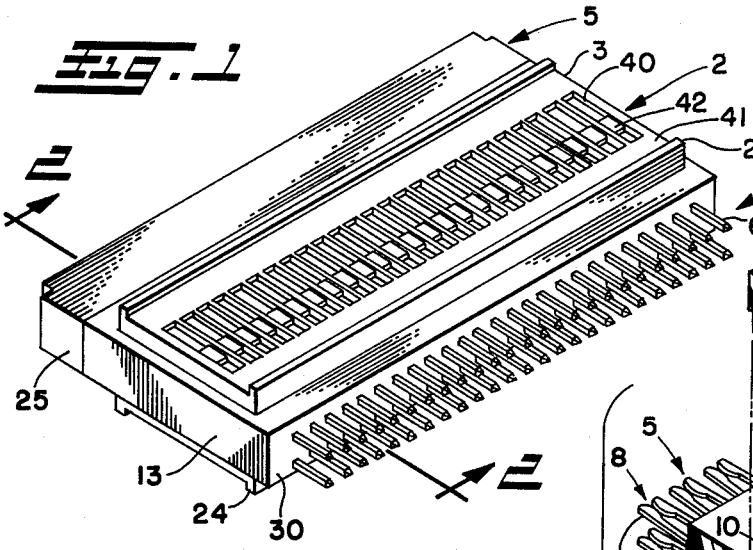
FIG. 1 is an isometric view of an improved multiple switch device in accordance with the invention.

Referring now more particularly to the drawing, wherein like reference numerals designate like parts in the several figures, the improved multiple switch device is generally indicated at 1 in FIG. 1. The fundamental elements of the multiple switch device 1 include a plurality of slide switches 2 located in a dielectric housing 3 for selectively opening and closing circuit paths between a plurality of femal electrical contacts 4, seen in FIGS. 2, 3, and 4, in a first connecting portion 5 and a plurality of respective male electrical contacts 6 in a second connecting portion 7, respectively. Although the electrical contacts 4, 6 are illustrated as female and male type, they may both be of the same type or of other different types, as desired.

Figure 3:
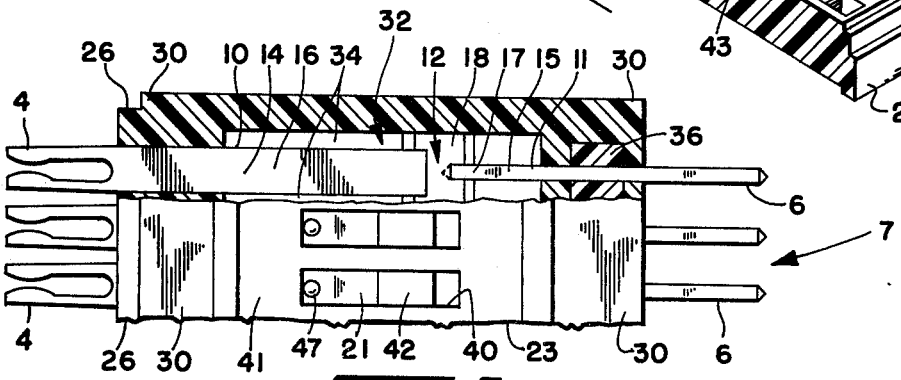
FIG. 3 is a partial top plan view of the improved multiple switch device partially broken away in section generally at the location of the arrows 3—3 of FIG. 2.

The electrical contacts portions 4, 6 are arranged, for example, in respective dual-in-line patterns, as is seen in FIG. 3, or they may be arranged in any other desired pattern to facilitate their connection with the respective contacts, for example, of a termination of a cable termination assembly and those of a receptacle with which such assembly may be connected. When the multiple switch device 1 is so connected, each of the slide switches 2 may be selectively adjusted to open or to close respective circuit paths or switch circuits 8 between the contacts of such assembly and such receptacle.

To form each of the slide switches 2 of the switch circuits 8, each of the electrical contacts 4, 6 has an end extension 10, 11, respectively, that are positioned in paired linear alignment in the housing 3 with a space 12 provided between the confronting ends of the extensions to assure electrical isolation thereof. An electrically non-conductive common body part 13, for example of plastic-like material, is molded about the electrical contacts 4, 6 to secure the same in an integral structure with the respective female and male ends thereof protruding in the connecting portions 5, 7 for external connection and the end extensions 10, 11 having exposed surfaces 14, 15, which provide the respective fixed switch contact portions 16, 17 of the slide switches 2. Preferably the exposed surfaces 14, 15 of each pair of aligned fixed switch contact portions 16, 17 are generally coplanar and the common body part 13 is formed with an electrically non-conductive bridge 18 in the space 12 having a surface coplanar with those of the contact extension ends thereby providing a substantially mechanically complete linearly extending flat surface. The slide switches also include respective electrically conductive slide contact members 20 retained in slide holders 21 and having respective pairs of contacting parts **22*a*, 22*b*** respectively in engagement with parts of linearly extending flat surfaces to slide or to glide thereon.

The slide contact members 20 preferably are resilient, and the slide holders 21 in cooperation with molded housing inserts 23, 24 of the dielectric housing 3 urge the paired contacting parts **22*a*, 22*b* to engagement with the respective flat surfaces. Accordingly, each slide contact member 20 may be slid on its supportive flat surface to a first, circuit closing, position with the contacting parts 22*a*, 22*b* respectively engaging the fixed switch contact portions 16, 17, as is shown in the upper half of FIG. 2, or to a second, circuit opening, positon with the contacting parts 22*a*, 22*b* engaging only the fixed switch contact 17 and possibly also part of the bridge 18, as is shown in the lower half of FIG. 2**.

Due to the flatness of the surfaces on which the contacting parts **22*a*, 22*b* of the slide contact members 20 are supported, as the slide contact members are slid to open or to close respective switch circuit 8, the contacting parts will tend to glide relatively smoothly on the respective flat surfaces to facilitate switch operation. Moreover, since the space 12 is filled by the bridge 18, wearing of the fixed switch contact portions 16, 17 and/or of the slide contacting parts 22***a*, 22*b* that might occur, if the space 12 were open whereby the contacting parts 22*b* might snap down into the relative recess or gap between confronting fixed switch contacts at each space 12 and then back up onto the surface of the respective fixed switch contact as the slide contact members 20 are moved to their respective positions, is avoided. Also, due to the continuous gliding movement of the slide contact members 20 to their respective positions, closure and opening of the respective switch circuits 8 occur promptly as soon as each contacting part 22*b* engages or leaves the surface is of its fixed switch contact 17.

The dielectric housing 3 includes the common body part 13, the housing inserts 23, 24, and a cover 25 over the female fork contacts of the second connecting portion 7. The cover 25, which may be secured to the common body part 13 at a step 26, for example, by ultrasonic welding, may have front openings and interior walls, not shown, to guide pin contacts, for example, also not shown, to proper engagement with the respective fork contacts 7.

Figure 4:
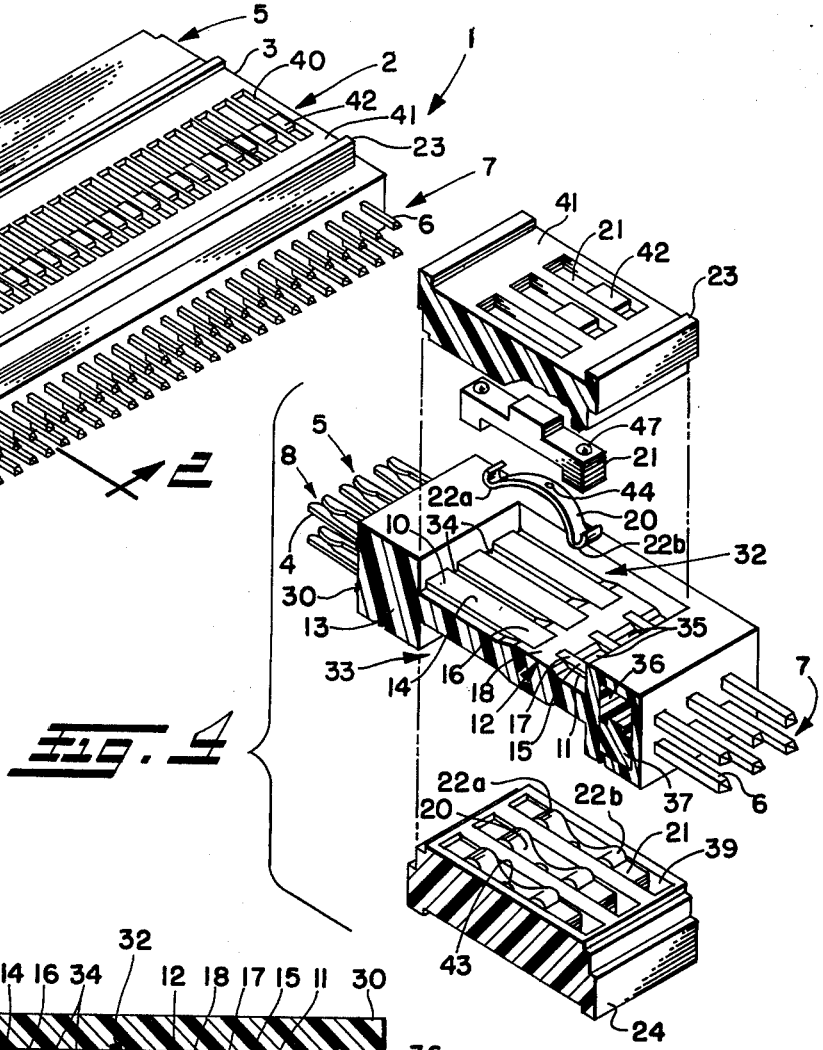
FIG. 4 is a partial exploded isometric view of the multiple switch device with the housing cover removed.
Figure 2:
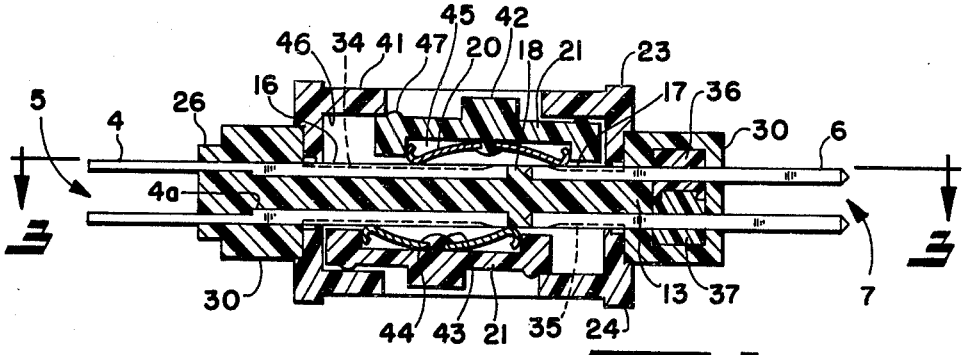
FIG. 2 is a section view of the improved multiple switch device with the housing cover removed looking generally in the direction of the arrows 2—2 of FIG. 1 and showing the top slide switch closed and the bottom slide switch open.

As is illustrated most clearly in FIGS. 2, 3, and 4, the common body part 13 has a relatively thick peripheral or perimeter portion 30 that encases a part of each of the contacts 4, 6 securing them in place and a relatively thinner central area 31 to define respective top and bottom cavities 32, 33 in which the surfaces 14, 15 of the contact end extensions 10, 11 are exposed. The common body part 13 is formed with channels or recesses 34, 35 between respective adjacent parallel contact end extensions 10, 11 to assure exposure of the contact surfaces 14, 15 to the contacting parts 22*a*, 22*b* of the slide contact member 20. These channels taper relatively gradually to the surface of the bridge 18 further to avoid interference with the smooth gliding action of the slide contact members 20 as they are slid to their respective positions.

The male and/or female contacts may be stepped, notched, or similarily formed with a surface discontinuity, for example, as is shown at 4*a* in the female contacts 4 in FIG. 2 to lock with the molded common body part 13 thereby to increase the strength with which they are held in the common body part. Moreover, if desired, and as is shown, for example, in the drawing, the male pin contacts 5 may first be fixed in respective headers 36, 37, which are formed of electrically non-conductive material molded about parts of the pin contacts to secure them in place in relatively elongated, generally rectangular cross-section header bodies, thereby to facilitate placement of the pin contacts in proper relative positions for molding into the common body part 13, as is illustrated in FIGS. 2, 3, and 4.

The molded housing inserts 23, 24 are secured to the common body part 13 to cover the respective top and bottom cavities 32, 33, for example, by ultrasonic welding or other fastening technique. A plurality of hollow channels 39 are formed, respectively, in the inserts 23, 24. Each hollow channel is located facing a respective flat surface of an aligned pair of fixed switch contacts 16, 17 and the channels include slotted apertures 40 in the exterior walls 41 of each insert for exterior access to the slide holders 21, so the latter can be slid in alignment with such respective flat surfaces. The linear extent or dimension of the slide holders 21 and the linear extent of the slotted apertures 40 are such that regardless of whether the slide holders are in the first, circuit closing, position or second, circuit opening, position, the slide holders will be retained in the hollow channels.

Each slide holder 21, moreover, includes a raised slide actuator 42 that facilitates selective sliding of the slide holder 21 and the slide contact member 20 therein in a hollow channel 39. Preferably the slide actuators 42 are located beneath the outermost plane of the insert exterior walls 41 to preclude inadvertent movement of the slide holders 21. In the preferred embodiment the size of the slide actuators 42 and the dimensions of the slotted apertures 40 are such that direct manual movement of the slide holders 21 may be difficult or impossible; rather, it is preferred that a relatively pointed instrument, configured, for example, like a pencil point or the like, may be placed to abutment with respective slide actuators and utilized to effect such movement of the slide holder 21 by a force having initially a slight vertical component and also having a horizontal component, as will become more apparent from the following description.

Each slide contact member 20 is secured in its respective slide holder 21 by a protrusion 43 of the latter that passes through an opening 44 in its slide contact member and is peened, squashed or flattened to hold the slide contact member in place. The slide contact members 20, which are preferably resilient, have their remote ends beyond the respective contacting parts 22*a*, 22*b* turned upwardly to facilitate bending within respective hollows 45 of the slide holders 21. When the housing inserts 23, 24 are assembled in the common body part 13 with the slide contact members 20 and slide holders 21 positioned generally as shown in FIGS. 2, 3, and 4, the slide contact members 20 are resiliently deformed as the contacting parts 22*a*, 22*b* abut the respective flat surfaces of the contact and extensions 10, 11 and/or the bridge 18 and the tops of the slide contact members 20 at their respective openings 44 are urged toward those flat surfaces by the slide holders 21 and the interior surface 46 of the exterior wall 41. Therefore, as the resilient slide contact members 20 slide over the respective fixed switch contacts 16, 17 they wipe the same and make good electrical connection therewith.

Raised bumps or protuberances 47 located near opposite ends of each slide holder 21 provide mechanical, visual and/or audible signals that the slide holder has reached one of its first and second positions and also provide a locking function to hold the slide holder in one of those positions until deliberately moved. The protuberances 47 are spaced away from the respective ends of the slide holder 21 so that when the slide holder is moved, for example, to its first or right-hand, circuit closing position, as is shown in the top half of FIG. 2, one of the protuberances slides out from beneath the interior surface 46 of the exterior wall 41 and is exposed in the slotted aperture 40. Such exposure is visible and occurs with a relatively snapping action under the resilient influence of the slide contact member 20 providing an audible and mechanical indication that the slide holder has been moved fully to such position. The opposite protuberance acts similarly when the slide holder 21 is moved to its second or left-hand, circuit opening, position, as illustrated in the lower half of FIG. 2. Moreover, a protuberance 47 exposed in a slotted aperture 40 also provides a locking function for the slide holder interfering with the exterior wall 41 at the edge of the slotted aperture 40 to resist movement of the slide holder until the latter is deliberately urged by the described pointed instrument or the like to an opposite position. As is evident, the height of the protuberances 47 above the major body of the slide holders 21 is less than the clearance of the slide holders above the flat surfaces of the respective slide switches 2 so that the slide holders normally will not engage those surfaces.

When the improved multiple switch device 1 is connected on-line, for example, between a multiple cable termination assembly and its receptacle, the respective slide switches 2 may be selectively positioned to close the respective circuits between the assembly and receptacle. Alternatively, the slide switches 2 may be adjusted to open all of those circuits or to open some of them, as desired, for example, to program the overall electrical apparatus in which the assembly, switch device 1, and receptacle are utilized to obtain prescribed circuit activity in that apparatus. Moreover, it will be appreciated that the form of the electrical contacts in the improved multiple switch device and their pattern arrangement therein may be varied, for example, depending on the external contacts or the like of the cable termination assembly, receptacle, or the like to which the multiple switch device 1 is to be attached. Also, although the fixed switch contacts 16, 17 and the slide contact members 20 preferably have flat abutting surfaces for maximum contact therebetween, either may be of round or other cross-section as long as there is a satisfactory contacting therebetween.

The embodiments of the invention in which an exclusive property or privilege is claimed are defined as follows:

1. A multiple switch mechanism connectable on-line with one multi-conductor electrical cable termination assembly device, a receptacle device therefor or like device and another similar device for selectively opening and closing electrical circuits therebetween, comprising:

a plurality of first electrical contacts, a plurality of second electrical contacts, electrically non-conductive housing means for holding said first electrical contacts in paired and electrically isolated alignment, respectively, with said second electrical contacts, said housing means including a body of electrically non-conductive material molded directly about portions of said electrical contacts forming an integral structure therewith, each of said electrical contacts including one end portion means exposed relative to said body for connecting to respective external contacts or the like of such device, each of said electrical contacts further including an opposite end portion means within said housing means and exposed therein for providing respective first and second fixed switch contacts in such paired alignment relation, and a plurality of slide contact means in said housing means selectively slidable on respective electrical contact opposite end portion means for closing and opening respective circuit paths between respective aligned pairs of said first and second electrical contacts respectively to open and close such electrical circuits therebetween.

2. A multiple switch mechanism as set forth in claim 1, wherein said plurality of first electrical contacts comprise female-type contacts, and said housing means comprises cover means over said female-type contacts for covering said one end portion means of said female-type contacts to guide male-type contacts to engagement therewith.

3. A multiple switch mechanism as set forth in claim 1, further comprising header means for holding said plurality of second electrical contacts in relative fixed positions, and wherein said body is molded about at least a portion of said header means to secure the same in said integral structure.

4. A multiple switch mechanism as set forth in claim 1, wherein each of said aligned pairs of first and second fixed switch contacts includes respective generally coplanar surfaces on which said slide contact means slides, and wherein said body includes electrically non-conductive bridge means between aligned pairs of respective first and second fixed switch contacts and generally coplanar with said surfaces thereof for completing a mechanical path therebetween.

5. A multiple switch mechanism as set forth in claim 4, wherein said respective aligned pairs of first and second fixed switch contacts extend in said housing means generally in parallel linear directions, and wherein said body includes respective recessed surfaces adjacent respective pairs of parallel fixed switch contacts and recessed relative to said surfaces of the latter to form generally linear, open channel-like areas therebetween, whereby said surfaces of said fixed switch contacts are raised relative to the recessed parallel extent of said channel-like areas of said body.

6. A multiple switch mechanism as set forth in claim 5, wherein said channel-like areas taper gradually and relatively smoothly to said bridge means.

7. A multiple switch mechanism as set forth in claim 4, wherein each of said slide contact means is resilient and includes contacting portion means for resiliently engaging said coplanar surfaces of respective aligned pairs of first and second fixed switch contacts.

8. A multiple switch mechanism as set forth in claim 7, wherein said housing means further comprises insert means attached to said body for covering said exposed opposite end portion means of said electrical contacts, wherein each of said slide contact means comprises a resilient electrically conductive slide contact and an electrically non-conductive holder therefor, wherein said insert means includes guide means for guiding said slide contact means for movement in the directional extent of said fixed contacts, wherein said insert means and said holders are cooperable to urge said slide contacts into such resilient engagement with respective coplanar surfaces of said fixed contacts, and wherein said holders include surfaces aligned with said coplanar surfaces for abutting the same to prevent over-stressing of said slide contact means.

9. A mutliple switch mechanism as set forth in claim 8, wherein said pluralities of first and second electrical contacts are positioned in respective dual-in-line patterns.

10. A multiple switch meachanism as set forth in claim 4, wherein said pluralities of first and second electrical contacts are positioned in respective dual-in-line patterns.

11. A multiple switch mechanism as set forth in claim 10, wherein said body includes cavity means on opposite sides thereof for exposing respective rows of said opposite end portion means of said electrical contacts in such dual-in-line patterns.

12. A multiple switch mechanism as set forth in claim 11, wherein said housing means comprises insert means for covering each of said cavity means, and wherein said insert means includes means for guiding said slide contact means for such sliding movement on respective pairs of fixed switch contacts.

* * * * *